United States Patent [19]

Sorenson

[11] 4,347,417

[45] Aug. 31, 1982

[54] SWITCH CONSTRUCTION

[75] Inventor: Richard W. Sorenson, Avon, Conn.

[73] Assignee: Carlingswitch, Inc., West Hartford, Conn.

[21] Appl. No.: 234,664

[22] Filed: Feb. 17, 1981

[51] Int. Cl.[3] ..... H01H 9/18; H01H 5/06; H01H 21/42

[52] U.S. Cl. ..... 200/67 G; 200/68; 200/315; 200/339

[58] Field of Search ..... 200/67 G, 68, 252, 260, 200/315, 339

[56] References Cited

U.S. PATENT DOCUMENTS

| | | | |
|---|---|---|---|
| 3,035,134 | 5/1962 | Hults | 200/67 G |
| 3,158,704 | 11/1964 | Sorenson | 200/67 G |
| 4,101,749 | 7/1978 | Josemans et al. | 200/315 |
| 4,127,754 | 11/1978 | Josemans et al. | 200/153 K |
| 4,145,586 | 3/1979 | Swann | 200/68 |

FOREIGN PATENT DOCUMENTS

| | | | |
|---|---|---|---|
| 2447378 | 4/1976 | Fed. Rep. of Germany | 200/315 |
| 2655478 | 6/1978 | Fed. Rep. of Germany | 200/315 |

*Primary Examiner*—John W. Shepperd

*Attorney, Agent, or Firm*—McCormick, Paulding & Huber

[57] ABSTRACT

A plastic switch actuator is fitted with a spring so as to impart sliding and rocking motion to a movable contact by virtue of direct engagement between spring and element. The actuator has a depending integral portion received in an opening of the element but it is the spring which keeps the element in contact with the fixed switch contacts. Other embodiments provide for illuminating the rocker in the miniature switch made possible by this simplified switch construction of fewer component parts. Still further embodiments provide for a toggle style actuator having a movable contact capable of retention in a "center-off" position wherein the movable contact is releasably retained on shelf-like lands defined for this purpose in the switch base, and wherein this contact can be moved by the depending actuator portion through joint action by the actuator and the spring provided on said actuator.

14 Claims, 20 Drawing Figures

SWITCH CONSTRUCTION

This invention relates generally to electrical switches having bases of an insulating material and with two or more fixed electrical contacts in the lower wall thereof. A movable contact element bridges selected ones of these fixed contacts, being movable through the actuator also of insulating material. The present invention deals more particularly with a unique configuration and location for the actuator and an associated spring whereby actuator motion causes the required pivoted and translational movement of the movable contact element across the fixed contacts without necessity for relatively reciprocable intermediate parts or components.

In other switch configurations the actuator has an internal lamp which may have its two leads connected to any combination of two of the following: the spring associated with the actuator, a second spring associated with a fixed switch contact, and a spring associated with a resistor element so arranged in its own recess in the switch case that the one end of this resistor can be electrically connected directly to a fixed contact of the switch. The spring associated with the actuator always contacts the movable contact element.

The general purpose of the present invention is to provide a unique switch construction having a minimum number of component parts, which switch construction also permits a lamp to be incorporated in the movable actuator portion of the switch and to be energized either through a spring associated with the actuator, or through a spring held in the base such that it may be associated with a resistor element connected directly to a fixed contact of the switch. This resistor preferably comprises a simple wire wound type with metal end caps and does not include lead wires and/or a plastic covering etc. Therefor, the resistor element is smaller than these plastic covered types and better suited to use in the unique switch construction disclosed herein.

These unique features can be provided in a switch base of double pole configuration to further expand the illumination possibilities for the externally visible portion of the actuator. The use of relatively inexpensive light weight springs to connect one or more of the lamp leads to a fixed terminal in the base eliminates soldering and the like. In addition, the lamp or bulb is free to move with the movable actuator in such a way that one or more such springs serve as lost motion conductive elements to minimize the degree of flexing and bending of lamp lead wires characteristic of prior art switch constructions.

Figure 1:
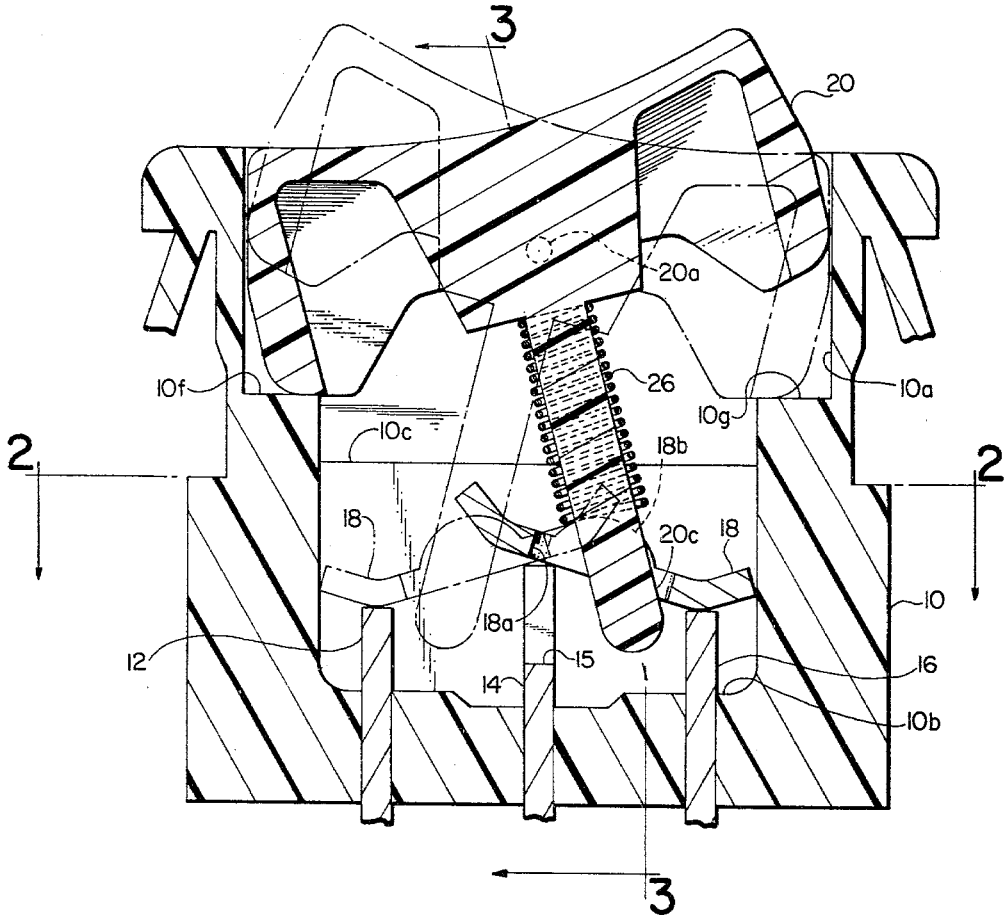
FIG. 1 is a vertical sectional view through a switch constructed in accordance with the present invention, and illustrates the actuator in one and an alternative position, the latter being indicated in broken lines.
Figure 2:
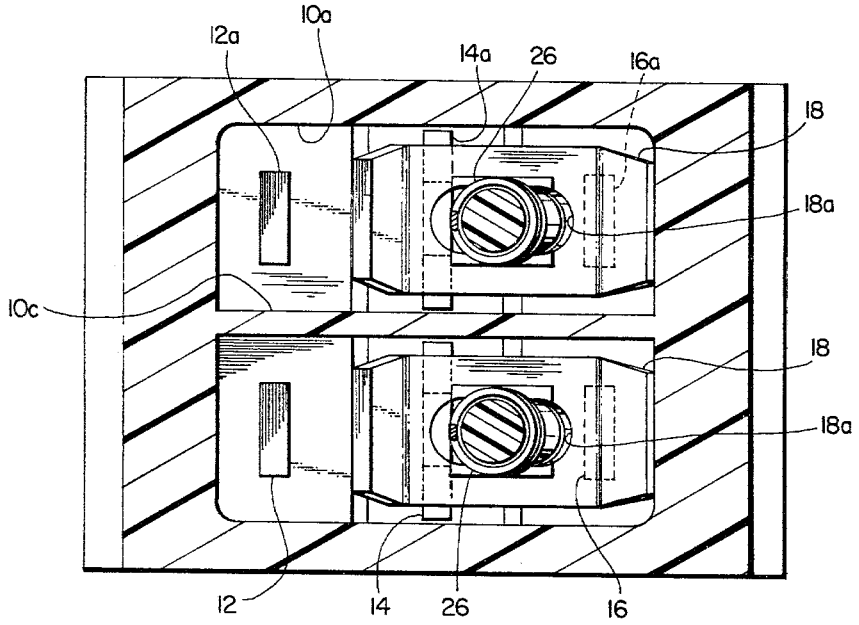
FIG. 2 is a sectional view taken generally on the line 2—2 of FIG. 1.
Figure 3:
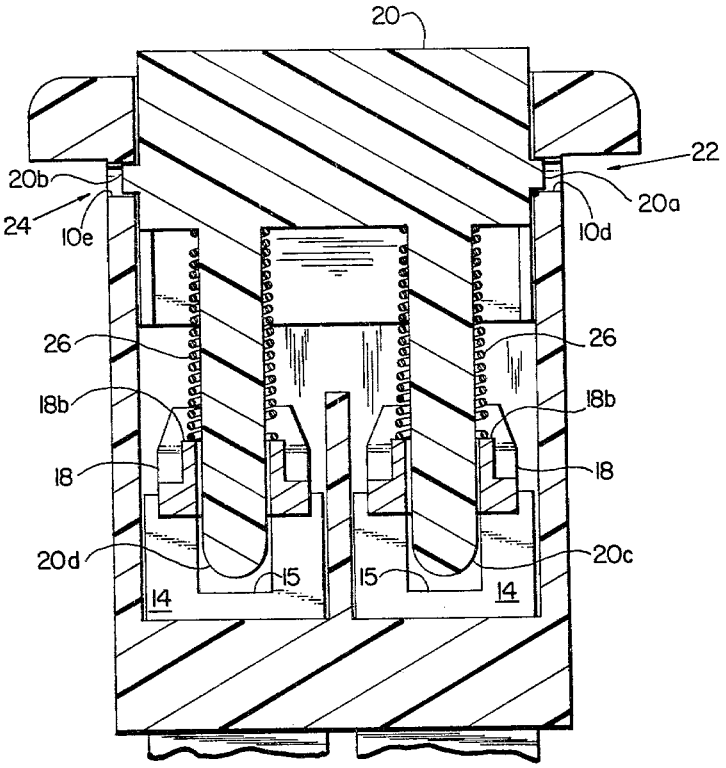
FIG. 3 is a sectional view taken generally on the line 3—3 of FIG. 1.

Turning now to the drawings in greater detail, FIGS. 1–3 inclusively show a preferred embodiment for the switch wherein the switch base comprises a one piece molded plastic part 10 having an upwardly open cavity 10*a*, which cavity is defined in part by a bottom wall 10*b*. The bottom wall is provided with at least two fixed contacts, and as shown three such contacts are provided, one centrally of the generally rectangular switch base as indicated generally at 14 in FIGS. 1 and 3, and two identical fixed contacts 12 and 16 provided on either side of the center contact 14. As best shown in FIG. 3, the upwardly open switch cavity 10*a* is divided into identical subcavities by a web-like wall portion 10*c*, and in the preferred embodiment shown the switch is of the double pole-double throw variety wherein two sets of three contacts are provided in the switch cavity 10*a* and more particularly in each of the subcavities defined by the median wall 10*c*. FIG. 3 indicates the location for the center fixed contacts 14 and 14*a* in this double pole-double throw switch arrangement and it will be apparent that fixed contacts 12*a* and 16*a*, best shown in FIG. 2, are provided to either side of this central fixed contact 14*a* in the same manner as referred to previously with reference to the contacts 12 and 16 of FIG. 1

A movable contact element is slidably received in each switch subcavity, as best shown in FIG. 2, and this movable contact element 18 is adapted to slide across the upper ends of the fixed contacts so as to selectively bridge certain of said fixed contact. As shown in FIG. 1 for example element 18 bridges the center contact 14 and the right hand fixed contact 16. In the alternative position shown in broken lines movable contact element 18 bridges the center fixed contact 14 and electrically connects this contact 14 to the other fixed contact 12.

As best shown in FIG. 3 switch actuator means 20 is movably supported in the switch case 10, and more particularly in the side wall defining means of the case as indicated generally at 22 and 24 in FIG. 3. As shown at 22 and 24 laterally aligned actuator support regions are defined in the side walls of the switch base in order to movably support the actuator 20 for movement between the alternative positions depicted in FIG. 1. The actuator 20 is provided with laterally outwardly projecting portions 20*a* and 20*b* which portions are received in laterally aligned openings 10*d* and 10*e* so that the actuator 20 is pivotally supported for movement between the positions shown in FIG. 1.

The switch base cavity 10*a* has appropriately located flats 10*f* and 10*g* defined in the locations shown in FIG. 1 for abutting the end portions of pivotally mounted actuator 20 in order to determine the limit positions for the actuator 20. Actuator 20 has a portion accessible from outside the switch case in order to permit movement of this member between the positions shown. As indicated in the drawings the actuator 20 is of the rocker type, but it will be apparent that other configurations for the external portion of the actuator might be substituted for the rocker configuration shown. For example, a paddle or toggle might be formed in the external portion of the actuator 20 without departing from the scope of the present invention.

An important feature of the actuator 20 resides in the fact that it has a depending portion 20 which is received in a recess defined for this purpose in the movable contact element 18 in order to assure the desired movement of the element 18 in response to the above described motion for the actuator 20. As best shown in FIG. 3 the actuator 20 has two such depending portions 20*c* and 20*d*, each of which portions is adapted to achieve the desired movement of one of the two contact elements 18, 18 in each of the subcavities defined within the switch case 10.

In further accordance with the present invention spring means 26 is provided on each of the depending actuator portions 20*c* and 20*d* and serves to bias each of the movable contact elements downwardly into engagement with the fixed contacts described above. The depending portions, and more particularly the lowermost end portions of these actuator portions are received in recesses 18*a* in each of the movable contact elements 18, and the lower end of each of the springs 26 engages upturned arcuately shaped portions 18*b* of the element 18 in order to yieldably urge element 18 downwardly while depending portion 20*c* of the actuator is moved arcuately about its associated pivot axis as defined by the support regions 22 and 24 described previously.

The center fixed contacts 14 and 14*a* are provided with relieved areas 15 which permit the lowermost end of the depending portions 20*c* and 20*d* to pass through these generally planar upstanding contacts 14 and 14*a*. The recesses or openings 18*a* in each of the movable contact elements 18 receive the depending portions 20*c* and 20*d* of the actuator 20 only quite loosely in order to permit rocking motion of each contact element 18 as it moves over the upstanding portion of fixed center contact 14. FIG. 2 shows to best advantage the degree of rocking motion possible with the contact element 18 and its associated depending actuator portion 20*c* and 20*d*. Although the spring means 26 does comprise a metal coil compression spring acting directly on the movable contact element 18, and therefor must of necessity be at the same electrical potential as element 18, spring 26 is electrically isolated from any other conductive parts as a result of its upper end being in engagement with a downwardly facing surface of actuator 20, said actuator being fabricated from insulating plastic material and being the only element of the switch in contact with the spring 26 other than the movable element 18 itself.

Figure 4:
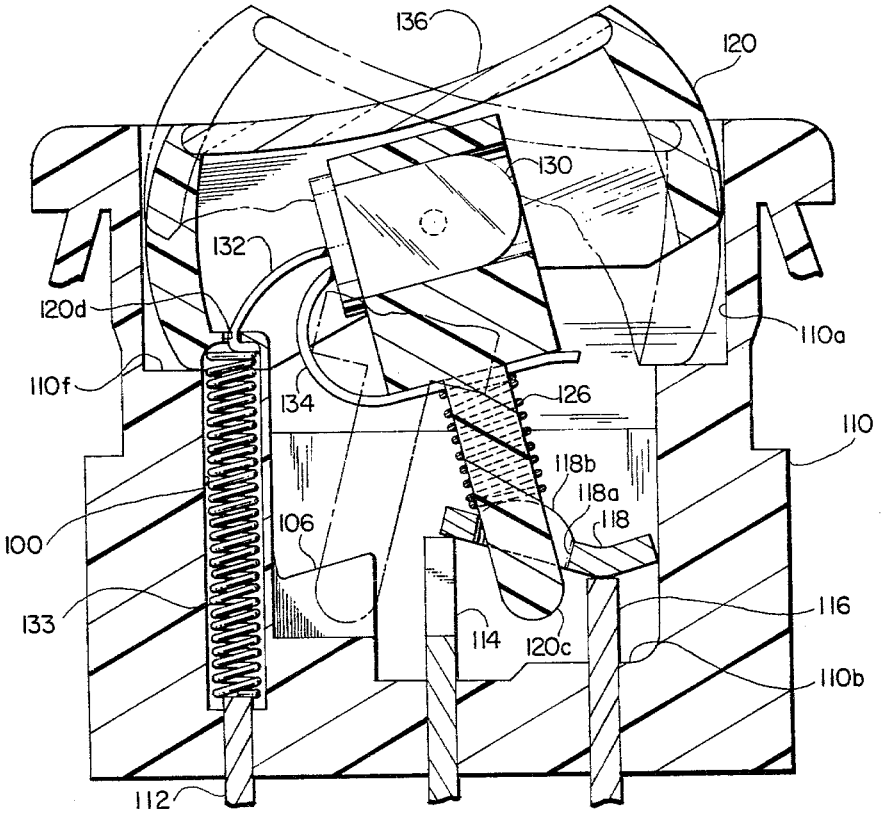
FIG. 4 is a vertical sectional view through a switch constructed in accordance with an alternative form of the present invention.

FIG. 4 shows an alternative switch construction incorporating many of the advantages from the switch construction of FIG. 1, and having a modified switch base configuration 110 with two fixed contacts or terminals 114 and 116 provided in the cavity 110*a* and a third terminal 112 in an elongated cavity 100 to be described. A movable contact element 118 provides selective electrical connection for the fixed contacts 114 and 116 under the action of spring 126 on the arcuate upper side of contact element 118 in much the same manner as described above with reference to the element 18 and surface 18*b*. The opening 118*a* of movable contact element 18 is adapted to loosely receive the depending portion 120*c* of an actuator means 120, which depending portion is generally similar to the depending portion 20*c* described above with reference to actuator 20 of FIGS. 1–3. A shelf 106 supports one end of contact element 118 in one of two switch positions to be described with reference to FIGS. 5 and 6.

Actuator means 120 includes a hollow interior portion adapted to house an indicator lamp 130, which may be an LED (light emitting diode). The LED 130 has two electrical leads 132 and 134, one of which leads is electrically connected to the upper end of the coiled compression spring 126 such that an electrical path is provided from the LED 130 to the movable contact 118. The other lead 132 associated with the LED or lamp 130 is preferably connected to the third terminal 112 through a spring 133 located in the elongated cavity 100. In a double pole switch such as shown in FIG. 2 for example this LED lead 132 might instead be connected to one of the terminals associated with the other pole (not shown) of the switch base 110. The terminal 112 associated with this lead 132 will generally be electrically connected to ground, and terminal 116 to an appropriate DC voltage for operating the LED. The circuit to be controlled by the FIG. 4 switch is then connected to central terminal 114.

The hollow rocker 120 is of integral one-piece plastic construction except for the provision of a transparent lens 136 provided in its upper end, and serving to provide a window for the illumination from the LED 130.

Figure 5:
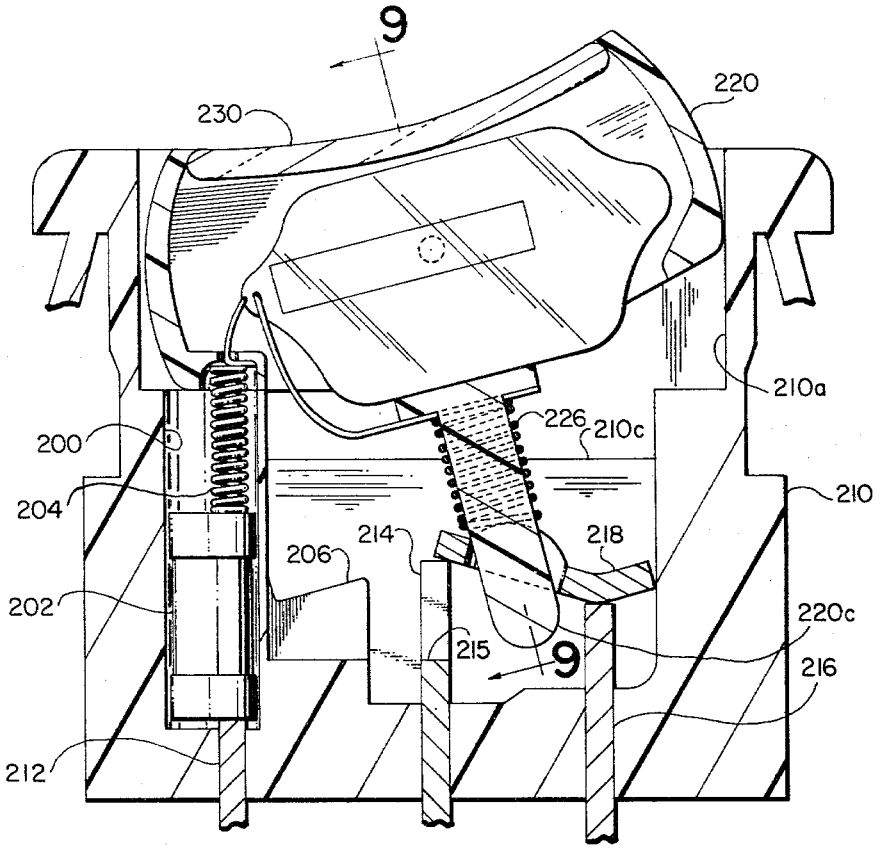
FIG. 5 is a sectional view of still another version for a switch incorporating the present invention.

Turning next to a detailed description of the switch illustrated in FIGS. 5–9 inclusively the switch base 210 is generally similar to that described above with reference to FIG. 4 that is, instead of having a generally symmetrical cavity such as shown in FIGS. 1–3 the movable contact 218 provided in internal cavity 210*a* of the switch illustrated in FIG. 5 has only two of its three terminals 214 and 216 projecting upwardly into this cavity 210*a*. The third terminal 212 has its upper end located at the bottom of an elongated cavity 200 housing a resistor 202 and a light coil spring 204 for a purpose to be described.

Figure 6:
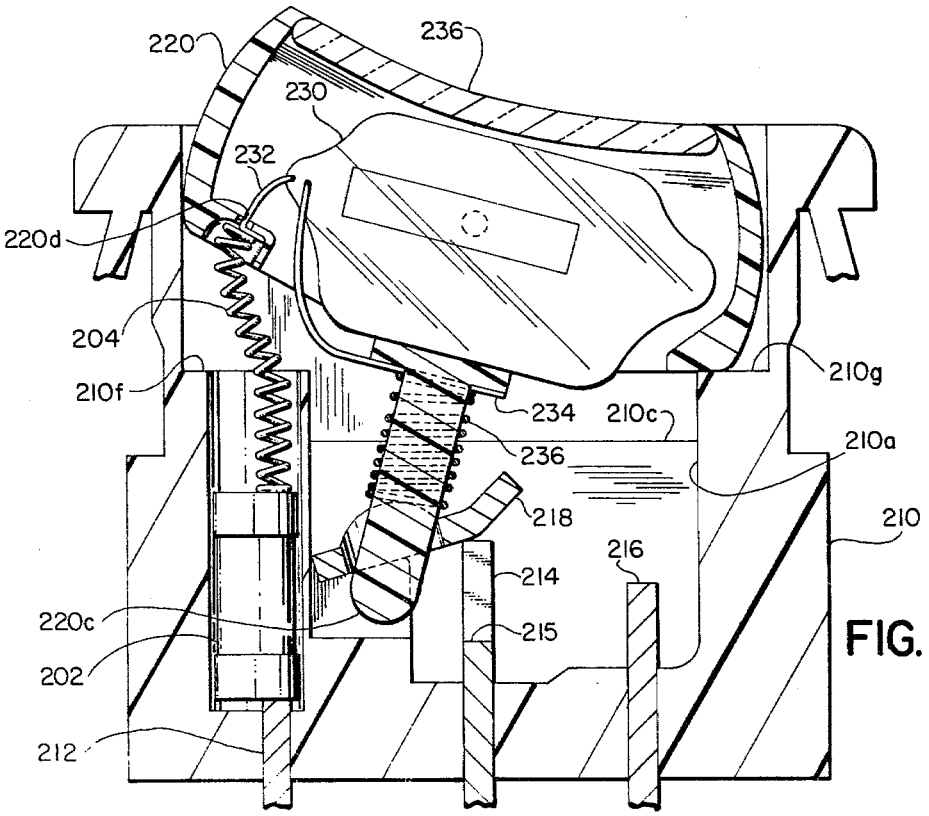
FIG. 6 is a view of the FIG. 5 switch with the actuator in an alternative position.

In order to provide at least two alternative positions for movable contact element 218 of the FIG. 5 switch (and of element 118 in the FIG. 4 switch), the bottom wall of the switch case cavity 210*a* (110*a* in FIG. 4) defines generally upwardly facing abutments 206 (106 in FIG. 4) against which the left hand edge of the movable contact element 218 (118 in FIG. 4) is adapted to rest when the switch is moved from the position shown for it in FIG. 5 to that shown in FIG. 6. The action of depending portion 220c of the rocker actuator 220 serves to support a coil compression spring 226 generally similar to the spring 26 described above with reference to FIGS. 1–3 inclusively. That is, the lower end of the spring 226 engages the upper surface 218b of movable contact element 218, and the upper end of spring 226 engages an abutment surface on the underside of the actuator 220, which actuator is formed of one-piece plastic construction, but is hollow so as to receive a lamp 230, and which actuator is fitted with a transparent plastic window 236. Furthermore, the upper end of the spring 226 engages a lead 234 associated with the lamp 230 in order to provide one leg of an electrical circuit for the lamp 230 when the switch is in at least one of its discrete positions.

The other lead 232 for lamp 230 held in the actuator 220 passes through a small opening 220d so as to be entrapped between the upper end of the light resistor connected spring 204, and the inner surface of a spring receiving recess defined for this purpose in the underside of the left hand end of the actuator 220. As best shown by way of comparison between FIGS. 5 and 6, expansion of the spring 204 will cause this lead 232 to remain in contact with the spring 204, and hence with the end of resistor 202 as the switch is moved between the positions shown for it in FIGS. 5 and 6. It will be apparent that the above described cooperation between the upper end of spring 204 and lead 232 is identical to that for spring 133 in FIG. 4 and LED lead 132 in FIG. 4. It will also be apparent that the presence of resistor 202 in the FIG. 5 switch permits 110 volt AC to be applied to terminal 216, and that lamp 230 will illuminate with the switch in this FIG. 5 position, and will not be illuminated in the FIG. 6 switch position. As in the FIG. 4 switch described above, terminal 212 will be connected to ground and center terminal 214 to the circuit to be controlled.

Figure 7:
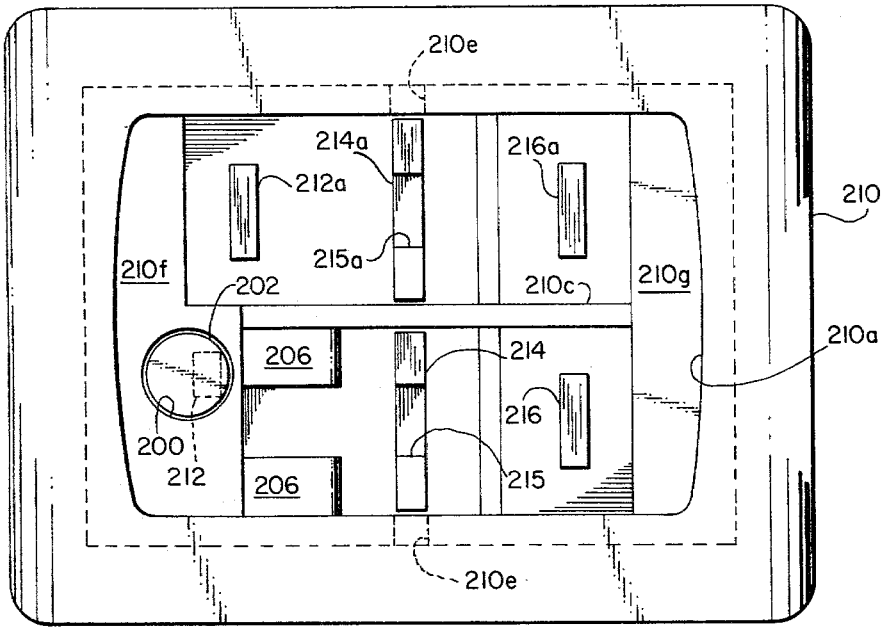
FIG. 7 is a plan view of the switch case illustrated in FIG. 6, but with the actuator and movable contact element eliminated.

FIG. 7 shows in plan view the switch base 210 with its upwardly open cavity 210a defining the side-by-side sub-cavities for each of the poles associated with this particular switch embodiment. One side of the switch cavity 210a defines the two contacts 214 and 216 illustrated in FIGS. 5 and 6, and also defines the elongated cavity 200 housing the resistor 202 and its associated light coil spring 204. It will be apparent that both sides of this switch might be identical, that is, with two resistors at each of the two terminals such as that described above with reference to the terminal 212. It will also be apparent that a second such resistor might instead be provided in an elongated cavity to replace the terminal 216a of FIG. 7. Other alternative switch configurations can be constructed given the unique concept of providing the uncoated resistor element (without lead wires) in a small cavity so that one metal end is in direct contact with a terminal and so that the opposite end of this very expensive resistor can be connected (without solder) to a lead wire of any conventional type lamp or LED. The light spring 204 serves not only as a convenient means for achieving such a solderless connection, but also serves the function of flexing to accommodate the switch actuator movement, a function formerly accomplished by the lamp's lead wire itself. This continuous flexing of the lamp lead wire can cause failure of the wire long before deterioration of other more rugged switch components.

Figure 9:
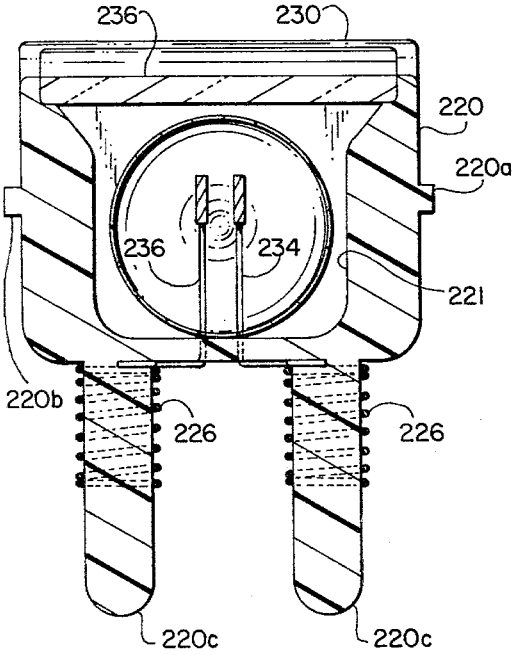
FIG. 9 is a sectional view taken generally on the line 9—9 of FIG. 5.
Figure 8:
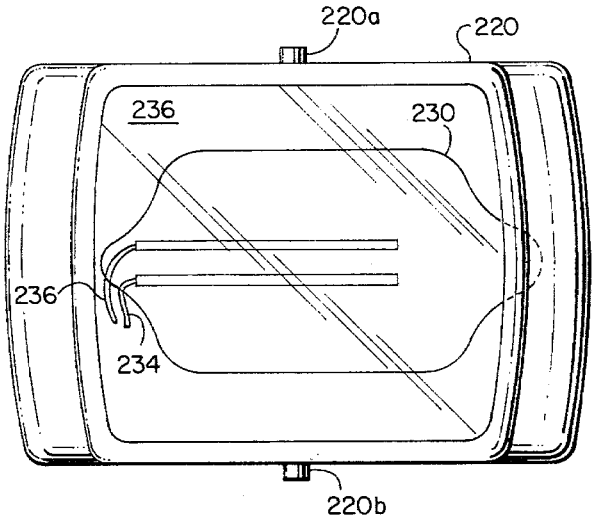
FIG. 8 is a plan view of the actuator omitted from FIG. 7 above.

FIG. 8 shows the rocker 220 with its projecting pivot defining means 220a and 220b which fit into aligned openings 210 in the side wall of the switch base 210. The transparent panel 236 covers the upper end of the hollow actuator 220. Finally, FIG. 9 shows the actuator 230 in vertical section, illustrating the upwardly open hollow configuration such that a cavity 221 is defined for receiving the lamp 230. The depending portion 220c of the one-piece plastic actuator 220 are fitted with springs 226, and one spring engages the movable contact element 218 described above with reference to FIGS. 5 and 6, whereas the other depending portion engages a more conventional movable contact element such as described hereinabove with reference to FIGS. 1–3 (see element 18 of these views).

Turning next to the drawings depicting the switch configuration of FIGS. 10–19 inclusively, these further alternative embodiments incorporate the same invention disclosed above with reference to FIGS. 1–9 inclusively, and these further views also illustrate that the present invention can be utilized in a toggle switch of the type disclosed in prior art U.S. Pat. No. 3,158,704 and others, and that the present invention is not limited to the environment of a rocker type switch such as that shown and described with reference to prior art U.S. Pat. No. 3,711,663. It will be apparent to those skilled in the art that the present invention can also be adapted to other style switches, including but not limited to slide switches and the like.

Figure 10:
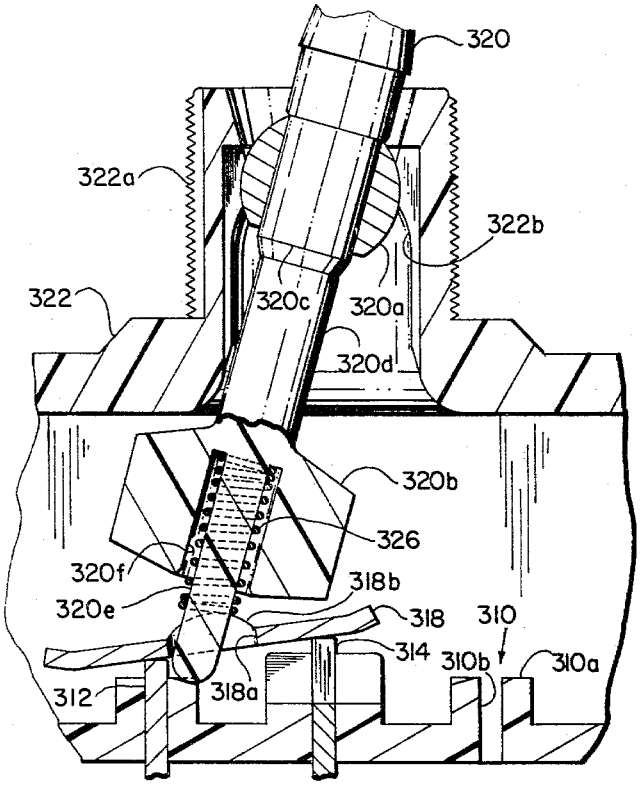
FIG. 10 is a vertical sectional view through a switch constructed in accordance with an alternative embodiment of the invention, with portions broken away to better show certain features of this embodiment.
Figure 11:
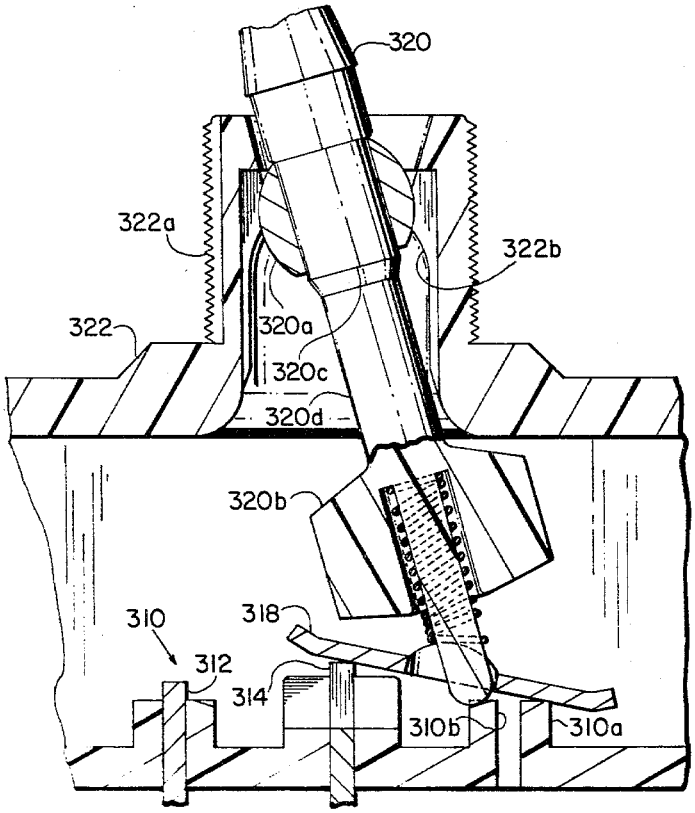
FIG. 11 is a view similar to FIG. 10 but shows the switch actuator in an alternative position.

Turning next to a detailed description of the alternative embodiment illustrated in FIGS. 10 and 11, this particular toggle switch has two positions as illustrated in these two views, and the toggle actuator 320 may comprise a one-piece plastic part as shown, or alternatively, may comprise an upper handle portion which is metal and which is connected at its lower end to a plastic member having the same geometry as the lower integral portion 320b illustrated in FIGS. 10 and 11. In the particular embodiment shown the one-piece plastic actuator 320 has a swaged metal partispherical ball 320a attached to an intermediate portion of the plastic shank 320c. This shank portion includes a reduced diameter portion 320d which may be sonically welded to the lower portion 320b in order to provide for assembly of these metal ball defining portions 320a. Alternatively the partispherical portion 320a may itself be formed of plastic material and in accordance with conventional practice this partispherical portion permits the toggle actuator 320 to move pivotally in the switch case between the position shown for it in FIGS. 10 and 11.

The switch case has been shown only to the extent necessary to disclose the present invention, and includes an upper cover portion 322 defining an upstanding boss 322a which may be threaded to receive suitable retaining nuts or the like in accordance with conventional switch technology. The inner portion of this boss 322a defines a surface for receiving the actuator toggle 320 in order that spring pressure can be applied upwardly to the toggle actuator 320 and thereby maintain the partispherical ball portion 320a in contact with the surface 322b for allowing the pivotal movement of the toggle actuator 320 as described.

The switch case further includes a base portion 310 which may be suitably connected to the cover portion 322 by conventional means, and this base 310 defines an upwardly open cavity shown in part in FIGS. 10 and 11 similar to that for the cavity 10a referred to previously with reference to the FIG. 1 switch configuration. Further, the lower bottom wall of this switch base 310 has provision for mounting two or more fixed contact strips two of which is shown at 312 and 314 in FIGS. 10 and 11. The third fixed contact is omitted from FIG. 10 switch in order to provide a switch position wherein the center terminal or contact 314 is electrically isolated, and the switch is thereby provided with a positive off position. More particularly, movable contact element 318 can be seen in FIG. 11 to have a left hand portion in contact with the upper end of fixed contact 314, but it will be apparent that the right hand end portion of the movable contact 318 engages only the upstanding plastic base 310 more particularly the upwardly projecting portion 310*a* provided adjacent the slot 310*b* which may be used for receiving a fixed contact (not shown). In the switch configuration shown in FIGS. 10 and 11 therefor movable contact element provides a switch off condition in the FIG. 11 position, and in the FIG. 10 position a switch on condition.

With particular reference to FIG. 10, the plastic actuator or toggle 320 can be seen to include a depending portion 320*e* defined by a generally annular slot 320*f* which slot is adapted to receive a spring 326, which spring serves the same function as that described herein above with reference to the previous embodiments by reference to numeral 26. More particularly the upper end of the spring 326 engages the actuator 320 to urge the actuator upwardly in the switch case in order to maintain the desired position of the toggle during movement of the switch between the two positions shown. The lower end of the spring 326 engages a convexly contoured pair of surfaces 318*b* similar to the surfaces described above with reference to the movable contact element 18. The spring 326 is therefore electrically connected to the movable contact element 318 and functions in the much the same manner as the spring 26 referred to previously. As the actuator 320 is moved from the FIG. 10 toward the FIG. 11 position the movable contact element 318 not only translates from left to right as a result of the slot 318*a* provided in the element 318 but said movable element 318 also pivots relative to the upper end of the fixed contact 314 providing a positive action for the element 318.

In summary the actuator 320 differs from the actuator 20 described above with reference to FIG. 1 for example in that the pivotal mounting is different but conventional. On the other hand, the lower end of the actuator 320 differs slightly from that shown in FIG. 1 by virtue of the spring 326 in the FIG. 10 switch having a receptacle for locating this spring in a somewhat more positive manner than that depicted in the previous embodiments of FIGS. 1–9 inclusively. It will be apparent to those skilled in the art that either configuration for the lower end of the actuator 320 or 20 can be varied within the scope of the present invention and it is noted that with the configuration illustrated in FIGS. 10 and 11 the lower portion 320*b* of the actuator 320 provides a convenient means for defining end abutment surfaces suitable for engaging the side walls of the switch case in order to permit rotation of the actuator 320 about the axis of its upper end or toggle portion. Since the rocker switch of FIGS. 1–9 inclusively does not provide for the same sort of spherical pivot, but rather as definitely defined projections for determining a single pivot axis, this particular design feature of providing for the engagement between the end walls of the lower portion of the actuator such as described above with reference to 320*b* need not be incorporated in the rocker switches of FIGS. 1–9 inclusively.

Figure 20:
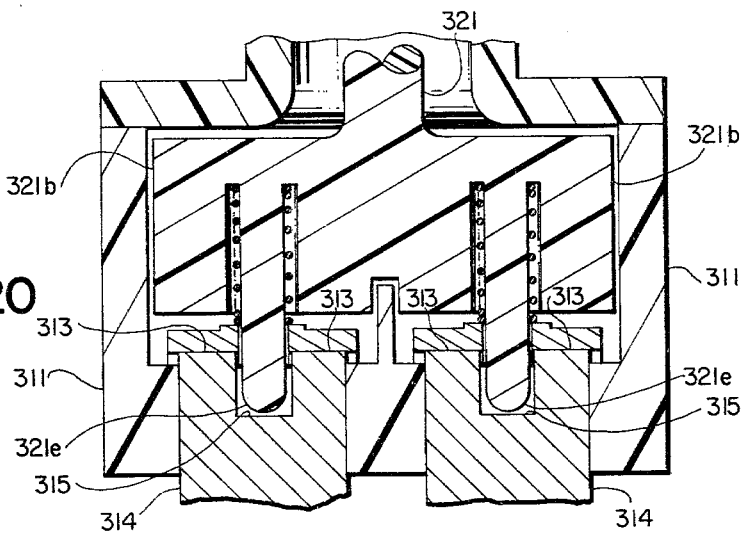
FIG. 20 is a sectional view through a double pole switch similar in all significant respects to the single pole switch of FIGS. 10 and 11.

It should also be noted that the single pole switch depicted in FIGS. 10 and 11 and the invention incorporated therein, can also be adapted for use in a double pole switch configuration of the type described above with reference to FIGS. 2 and 3. In a double pole switch of this type the toggle style actuator or FIG. 10 would very likely be made with the handle portion being designed for assembly with the lower portion defining the annular slots for the two springs required. Whereas in FIG. 10 the axis of the toggle portion of the actuator 320 is in line with the axis of the depending portion 320*e*, it will be apparent that in a two pole switch configuration such would not be the case, and as suggested in FIG. 20 the upstanding toggle portion of the actuator 321 would have its axis located intermediate the respective axes of the twin side-by-side depending actuator portions 321*e*, 321*e*. FIG. 20 shows how the side portions 321*b* of this double pole actuator 321 engage the side walls of the switch base 311 in order to restrict pivotal movement of the actuator toggle to a single plane, rather than to permit unrestricted freedom of movement pivotally in its spherical or partispherical bearing as described above.

Turning next to the toggle switch configuration illustrated in FIGS. 12–19, a toggle shaped actuator element is pivotally supported in an upper boss defining portion 422*a* of the switch cover 422 and these components of the three position switch illustrated in FIGS. 12–19 inclusively are or may be identical to the actuator 320, the cover 322, and the boss portion 322*a* of the switch illustrated in FIGS. 10 and 11. More particularly, the upper portion (not shown) of the toggle actuator 420 is pivotally supported for movement in at least one vertical plane, and has a lower portion 420*b* generally similar to that described above with reference to numeral 320*b* in FIGS. 10 and 11. That is, a downwardly open annular recess 420*f* houses a spring 426 and a depending portion 420*e* of the actuator 420 extends through this coil spring so as to engage the opposite edges of an opening 418*a* in a movable contact element 418, the lower portion 420*b* of the toggle actuator 420 may either be of the single pole variety described above with reference to FIGS. 10 and 11, or may comprise a double pole configuration such as that suggested in FIG. 20 referred to previously.

Figure 12:
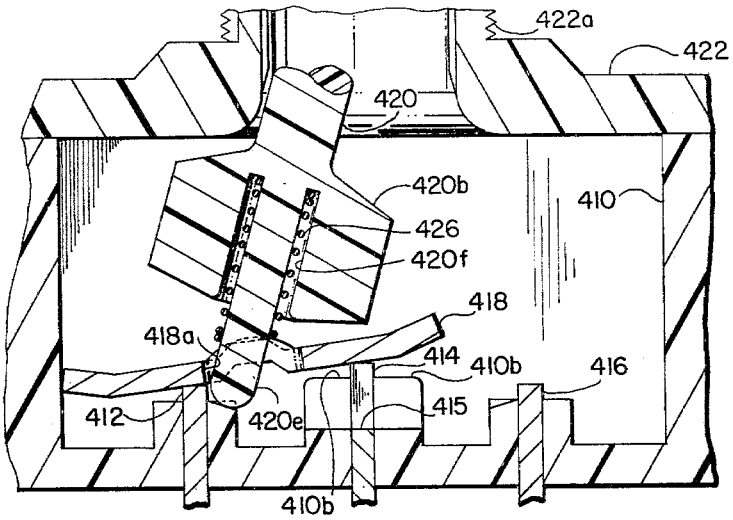
FIG. 12 is a vertical sectional view through a three position switch similar to the two position switch of FIGS. 10 and 11.
Figure 14:
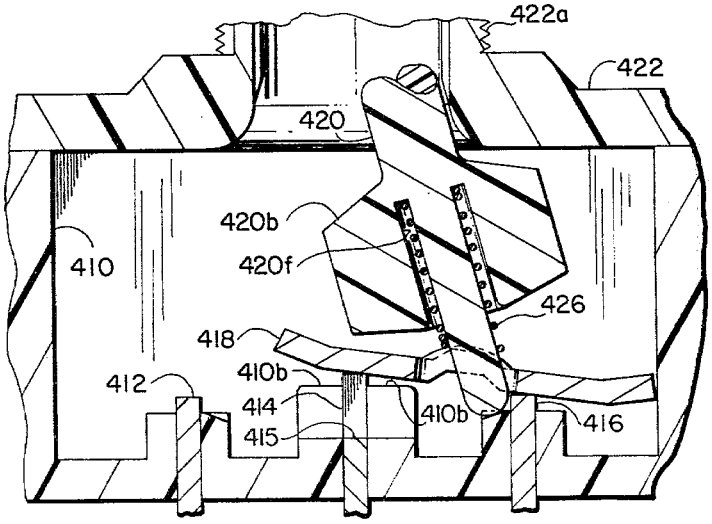
FIG. 14 is a view similar to FIGS. 12 and 13 but shows the switch actuator in a third position.
Figure 15:
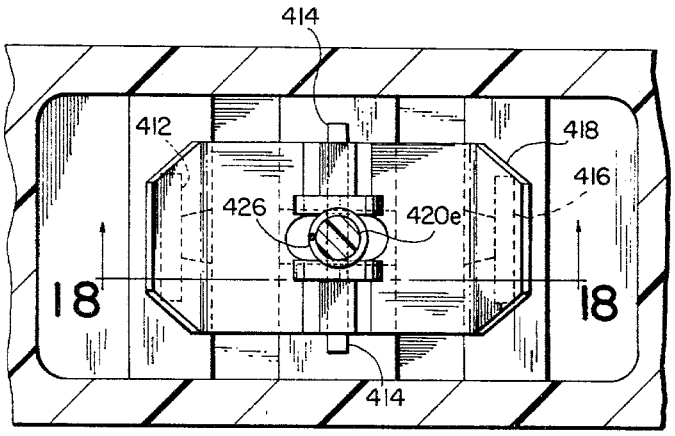
FIG. 15 is a sectional view taken along the line 15—15 of FIG. 13.

Although the actuator 420 is generally similar to that described above with reference to FIGS. 10 and 11 or FIG. 20, the movable contact element 418 is of different configuration being adapted for use in conjunction with the unique arrangement for the fixed contact elements in the lower wall of the switch case or base 410. This element is illustrated in some detail in FIG. 17, but prior to describing the element 418 in detail by reference to FIG. 17 it should be perhaps noted that the switch condition or position shown in FIG. 12 is generally similar to that described above with reference to the two position toggle switch of FIGS. 10 and 11 in that movable element 14 bridges fixed contacts 412 and 414 in this condition. Referring by way of reference to FIG. 14, the movable contact element 418 is there shown in an opposite position generally similar to that described above with reference to FIG. 11 for the two position switch, and wherein the movable contact element 418 bridges the fixed contacts 414 and 416.

Figure 13:
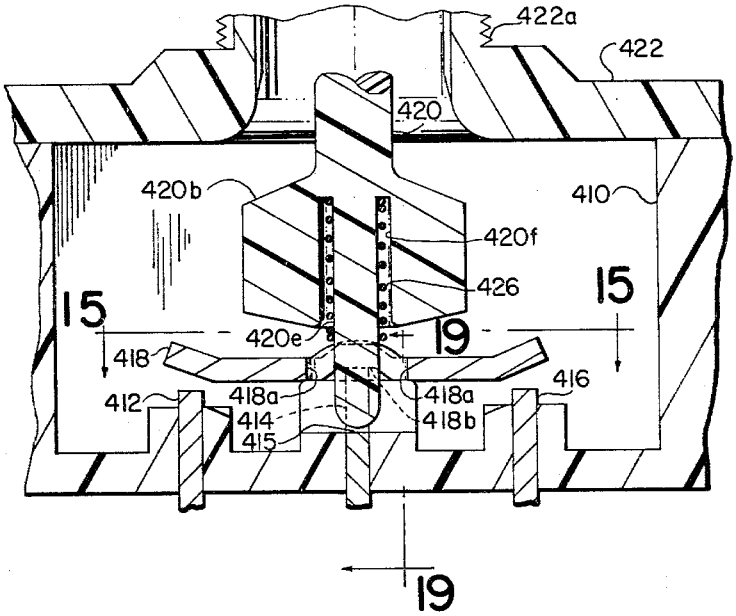
FIG. 13 is a view similar to FIG. 12 but shows the switch actuator in an intermediate second position.
Figure 16:
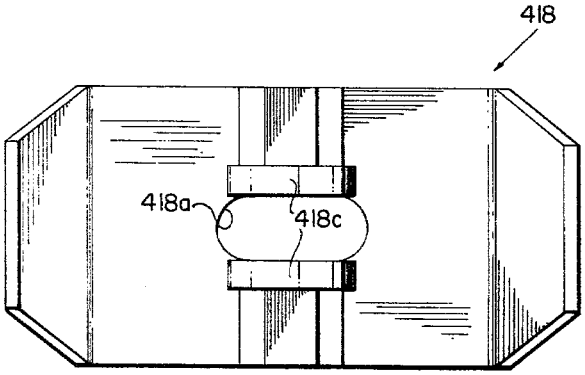
FIG. 16 is a plan view of the movable contact element shown in FIG. 15 in assembled relationship with other switch components.
Figure 17:
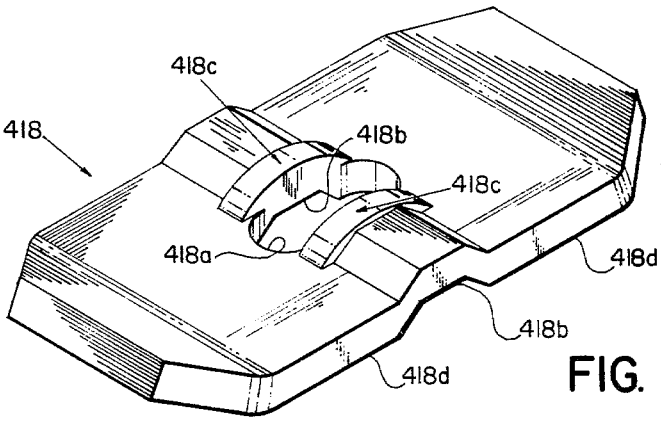
FIG. 17 is a perspective view of the FIG. 16 element.
Figure 18:
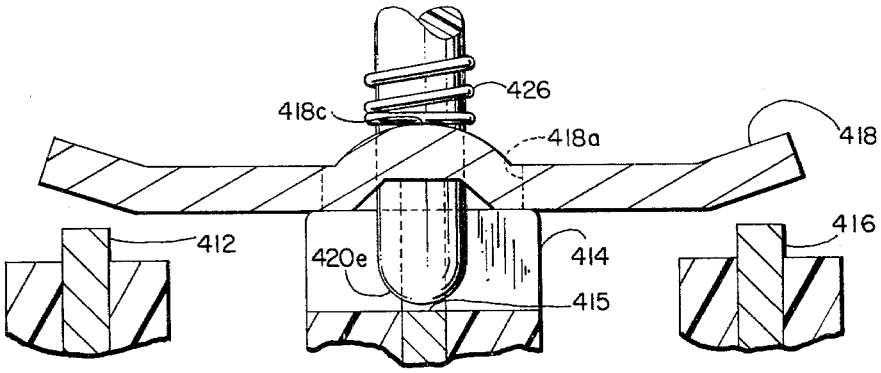
FIG. 18 is a sectional view taken on the line 18—18 of FIG. 15.
Figure 19:
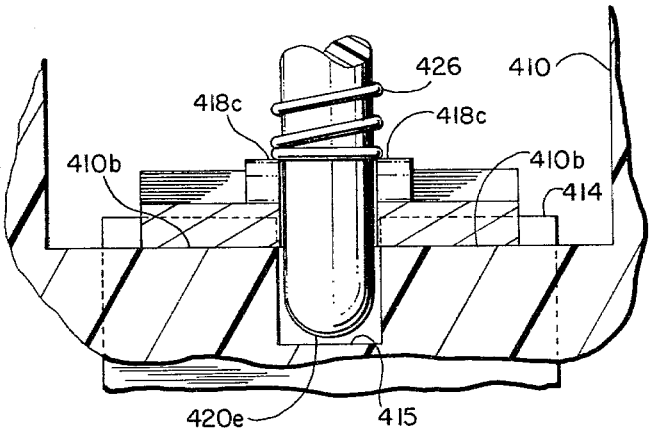
FIG. 19 is a sectional view taken on the line 19—19 of FIG. 13.

FIG. 13 illustrates the toggle actuator 420 in an intermediate "center-off" position wherein the movable contact element 418 is held by the spring 426 in a position isolated from each of the endmost fixed terminals 412 and 416. As in the FIG. 10 switch center fixed terminal 414 has a relieved center portion 415 similar to that shown in FIG. 20 by reference to numerals 315, 315. This clearance opening provides for motion of the depending portion 420*e* of the actuator 420 as the movable element 418 is moved from the FIG. 12 to the FIG. 14 position, and as said element 418 is held in the FIG. 13 position. With particular reference to FIG. 16, it will be apparent that the lower end of the coil spring 426 engages laterally spaced contact points on the raised convex surfaces as indicated at 418*c* in this view. FIGS. 16 and 17 show the general configuration for the movable contact element 418 to best advantage. With particular reference to FIG. 17 it will be apparent that the lower end of the spring 426 continually engages this convex surface, the actual point of contact shifting as the movable element itself is shifted between the positions shown for it in FIGS. 12 and 14. Still with reference to the FIG. 13 position (generally designated "center-off") it will be apparent from FIG. 13 that the underside of the movable element 418 has an intermediate flat portion or more correctly longitudinally spaced flat surfaces separated by a recess 418*b*. Actually two such laterally spaced recesses 418*b*, 418*b* are provided as best shown in FIG. 17 on either side of the opening 418*a* in the element 418, and the fixed contact 414 has uppermost end portions corresponding to the portions 313, 313 of the center contact 314 in FIG. 20 for the FIG. 10 switch. Thus, movable contact element 418 does engage this center contact 414 in the "center-off" position.

It is an important feature of the present invention that the aligned flats 418*d* on either side of the downwardly open recess 418*b* do engage the plastic bottom wall of the switch case or base 410. This engagement provides stability for the movable contact element 418 as it rests in its "center-off" position illustrated in FIG. 13. That is, the downward spring pressure exerted centrally of the movable contact element 418 at the points 418*c*, 418*c*, referred to previously is reacted by upward pressure from one or both of the upwardly facing surfaces 410*b*, 410*b* best shown in FIGS. 12 and 14. Thus, the plastic base 410 is molded with a suitable configuration for achieving this stable position of the movable contact element 418 without necessity for complicated conductive center yoke terminals to achieve this purpose as is true of many prior art switch arrangements of this three position type. The reader is referred to prior U.S. Pat. Nos. 3,158,704 and 3,711,663 for examples of the typical prior art geometry for achieving the "center-off" position with a movable contact element of the general type described herein. It is further noted that the element 418 described above is itself unique in that the flats 418*f*, 418*f* are adapted to be supported by the shelf-like portions 410*b*, 410*b* of the plastic base to define a stable "center-off" position for toggle actuator 420. In this position the upper ends of contact 414 engage movable element 418 at laterally spaced locations 418*b*, 418*b* and spring 426 engages spaced points 418*c*, 418*c*. The latter points of spring contact shift as the actuator is moved to the FIG. 12 or FIG. 14 positions, but it is important to note that the convex contour of the surfaces defining these points of spring contact always assures that the element 418 is urged downwardly toward the fixed contact by spring 426 as it is shifted between the positions shown in FIGS. 12, 13 and 14 by depending portion 420*e* of actuator 420.

I claim:

1. A switch comprising a base of insulating plastic and defining an upwardly open cavity, a plurality of fixed contacts spaced along the bottom wall of said base cavity, said switch having means defining actuator support regions, an actuator including support means cooperating with said support regions to movably support said actuator, said actuator molded of dielectric material and including an integrally formed depending portion, a movable contact element slidably received inside said switch base cavity for pivotal and translational movement generally across the upper ends of certain of said spaced contacts to selectively bridge said certain fixed contacts, a metal spring retained by said integrally formed depending actuator portion and engaging said movable contact element to bias said movable element toward said fixed contacts, said movable contact element having at least one upwardly open recess to loosely receive the lowermost end of said depending actuator portion and said movable contact element having raised laterally spaced portions adjacent said recess for slidably engaging said spring during actuator movement, whereby said element is moved in response to actuator movement and said spring serves as the sole lost motion connection between said contact element and said actuator.

2. The switch according to claim 1 wherein one of said plurality of fixed contacts has a planar upstanding portion in said switch base cavity, said planar portion being so oriented that it's uppermost edge engages the underside of said movable contact, and said depending actuator end portion adapted to move through the plane of said upstanding planar portion during movement of said movable contact element responsive to said actuator movement.

3. The switch according to claim 2 wherein said movable contact element recess for receiving said depending actuator end portion comprises a slotted opening through said contact element, said depending portion loosely received in said slotted opening to provide said pivotal motion of said contact element as it translates over said upstanding portion of said one fixed contact.

4. The switch according to claim 3 wherein said actuator is molded from plastic and wherein said support means for movably supporting said actuator comprises projections integrally formed in said plastic actuator, said projections received in complementary shaped openings in side wall means defined by said plastic base, said depending portion also integrally formed as part of said plastic actuator, said spring having a lower end engaging said movable contact element and an upper end engaging a downwardly facing surface also integrally defined in said actuator.

5. The switch according to claim 1 wherein said actuator defined support means for movably supporting said actuator comprises integrally formed projections received in complementary shaped openings in side wall means defined by said plastic base, said depending portion also integrally formed as part of said actuator, said spring having a lower end engaging said movable contact element and an upper end engaging a downwardly facing surface also integrally defined in said actuator.

6. A switch according to claim 5 wherein said actuator is hollow and houses an indicator lamp having two electrical leads, said upper end of said spring being electrically connected to one of said two lamp leads.

7. The switch according to claim 6 wherein said switch base defines at least one elongated cavity outside the path of movement of said movable contact element, a first contact in the end wall of said elongated cavity, a compression spring having at least a lower portion in said elongated cavity and an upper end portion electrically connected to the said one of said two electrical indicator lamp leads, said compression spring having its other end electrically connected to said fixed contact.

8. The switch according to claim 1 wherein said switch base defines at least one elongated cavity outside the path of movement of said movable contact element, a fixed contact in the end wall of said elongated cavity, a resistor in said elongated cavity and having one end in electrical contact with said fixed contact, a compression spring adjacent said resistor and having one end in said elongated cavity and in electrical contact with the other end of said resistor, said spring having its other end engaging said movable actuator, a lamp located in said actuator and having at least one electrical lead in electrical contact with said spring.

9. The switch according to claim 8 wherein said actuator defined means for movably supporting said actuator comprises integrally formed projections received in complementary shaped openings in side wall means defined by said plastic base, said depending portion also integrally formed as part of said actuator, said spring having a lower end engaging said movable contact element and an upper end engaging a downwardly facing surface also integrally defined in said actuator.

10. The switch according to claim 9 wherein said lamp has a second electrical lead electrically connected to said upper end of said spring.

11. A switch comprising a base defining an upwardly open cavity, a plurality of fixed contacts spaced along the bottom wall of said base cavity, said switch having side wall means defining aligned actuator support regions, actuator means having laterally aligned support means cooperating with said support regions to movably support said actuator means, said actuator means including a depending portion, a movable contact element slidably received inside said switch case cavity for movement generally across the upper ends of certain of said spaced fixed contacts to selectively bridge certain of said fixed contacts, said movable contact element having at least one upwardly open recess to receive said depending portion so that said element is moved in response to actuator means movement, said switch base defining at least one vertically elongated cavity outside the path of movement of said movable contact element, a fixed contact in the bottom wall of said vertically elongated cavity, a resistor in said elongated cavity and having one end in electrical contact with said fixed contact, a compression spring above said resistor and having one end in said elongated cavity and in electrical contact with the other end of said resistor, said spring having its other end engaging said movable actuator means, a lamp located in a recess defined by said actuator means, and at least one electrical lead from said lamp in electrical contact with said spring other end.

12. The switch according to claim 11 wherein said actuator means is pivotally mounted to said side wall means, said side wall means defined by said switch case and said switch case fabricated from an electrically insulative plastic, said actuator means being movable about a pivot axis spaced from said elongated cavity and said actuator means defining a downwardly open recess to receive said other end of said spring and said one electrical lamp lead having a portion located in said actuator means recess.

13. The switch according to claim 12 wherein said means yieldably mounted to said pivotally mounted actuator means comprises a compression spring having one end engaging said movable contact element and its other end in electrical contact with the other electrical lead from said lamp.

14. The switch according to claim 12 wherein said plastic switch base cavity for said movable contact element has its bottom wall more particularly defined by a stepped portion to slidably receive one end of said element in one position of said actuator means, said element having at least one alternative position wherein at least two fixed contacts are bridged as aforesaid.

* * * * *